US005529288A

United States Patent [19]

Cheng-I

[11] Patent Number: 5,529,288

[45] Date of Patent: Jun. 25, 1996

[54] STRUCTURE OF A HANDRAIL FOR A STAIRCASE

[76] Inventor: Lin Cheng-I, P.O. Box 82-144, Taipei, Taiwan

[21] Appl. No.: 284,223

[22] Filed: Aug. 2, 1994

[51] Int. Cl.[6] ..... E04F 11/18

[52] U.S. Cl. ..... 256/65; 256/59

[58] Field of Search ..... 256/65, 64, 63, 256/31, 35, 59

[56] References Cited

U.S. PATENT DOCUMENTS

| | | | |
|---|---|---|---|
| 2,310,593 | 2/1943 | Orlicki | 256/59 X |
| 3,194,361 | 7/1965 | Thurman | 256/65 X |
| 3,522,933 | 8/1970 | Braun, III | 256/65 X |
| 3,918,686 | 11/1975 | Knott et al. | 256/65 X |
| 4,220,316 | 9/1980 | Naka | 256/59 |
| 4,390,165 | 6/1983 | Murdock | 256/65 X |
| 5,396,740 | 3/1995 | Bocchi | 256/65 X |

*Primary Examiner*—Anthony Knight
*Attorney, Agent, or Firm*—Alfred Lei

[57] ABSTRACT

A structure of a handrail for a staircase including a rail formed with a first longitudinal groove at a lower side and a second longitudinal groove at an upper side, a plurality of supporters each having a curved connector, a wing portion connected with an end of the curved connector for slidably fitted into the longitudinal groove of the rail, and a tubular portion connected with another end of the curved connector, a base member fixedly secured to each of the supporters, a protective cap at both ends of the rail, a first U-shaped cover engaged with the first longitudinal groove of the rail, and a second U-shaped cover engaged with the second longitudinal groove of the rail.

1 Claim, 15 Drawing Sheets

STRUCTURE OF A HANDRAIL FOR A STAIRCASE

BACKGROUND OF THE INVENTION

It has been found that the prior art structure of a handrail for a staircase sold on the marketplace is difficult and time-consuming to assemble. As shown in FIG. 14, the prior art structure for a handrail of a staircase mainly includes a handrail 11 and a plurality of supporters 10. The handrail 11 is formed with a plurality of holes 16 at the bottom. The supporter 10 has a vertical tubular member 15 adapted to engage the hole 16 of the handrail 11, a protective flange 14, and a base plate 12 with a plurality of holes 13.

However, it is necessary to drill accurately a plurality of holes 16 in the handrail 11 in advance; otherwise, the holes 16 of the handrail 11 cannot be aligned with the corresponding supporters 15. In addition, the supporter 15 must be welded on the handrail 11 thereby causing much inconvenience in assembly.

FIG. 15 shows the structure of a prior art sash. As illustrated, the sash includes a curved surface 21 at the top, two vertical surfaces 22 and 23 at two sides, and a groove 24 at the bottom. Nevertheless, there is still a relatively large clearance between the sash and the door frame thereby making it impossible to keep the dust from outside.

Therefore, it is an object of the present invention to provide a structure of a handrail for a staircase which may obviate and mitigate the above-mentioned drawbacks.

SUMMARY OF THE INVENTION

This invention relates to a structure of a handrail for a staircase.

It is the primary object of the present invention to provide a structure of a handrail for a staircase which is easy to assemble.

It is another object of the present invention to provide a structure of a handrail for a staircase which is simple in construction.

It is still another object of the present invention to provide a structure of a handrail for a staircase which is facile to manufacture.

It is still another object of the present invention to provide a structure of a handrail for a staircase which is fit for practical use.

It is a further object of the present invention to provide a structure of a handrail for a staircase which is low in cost.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
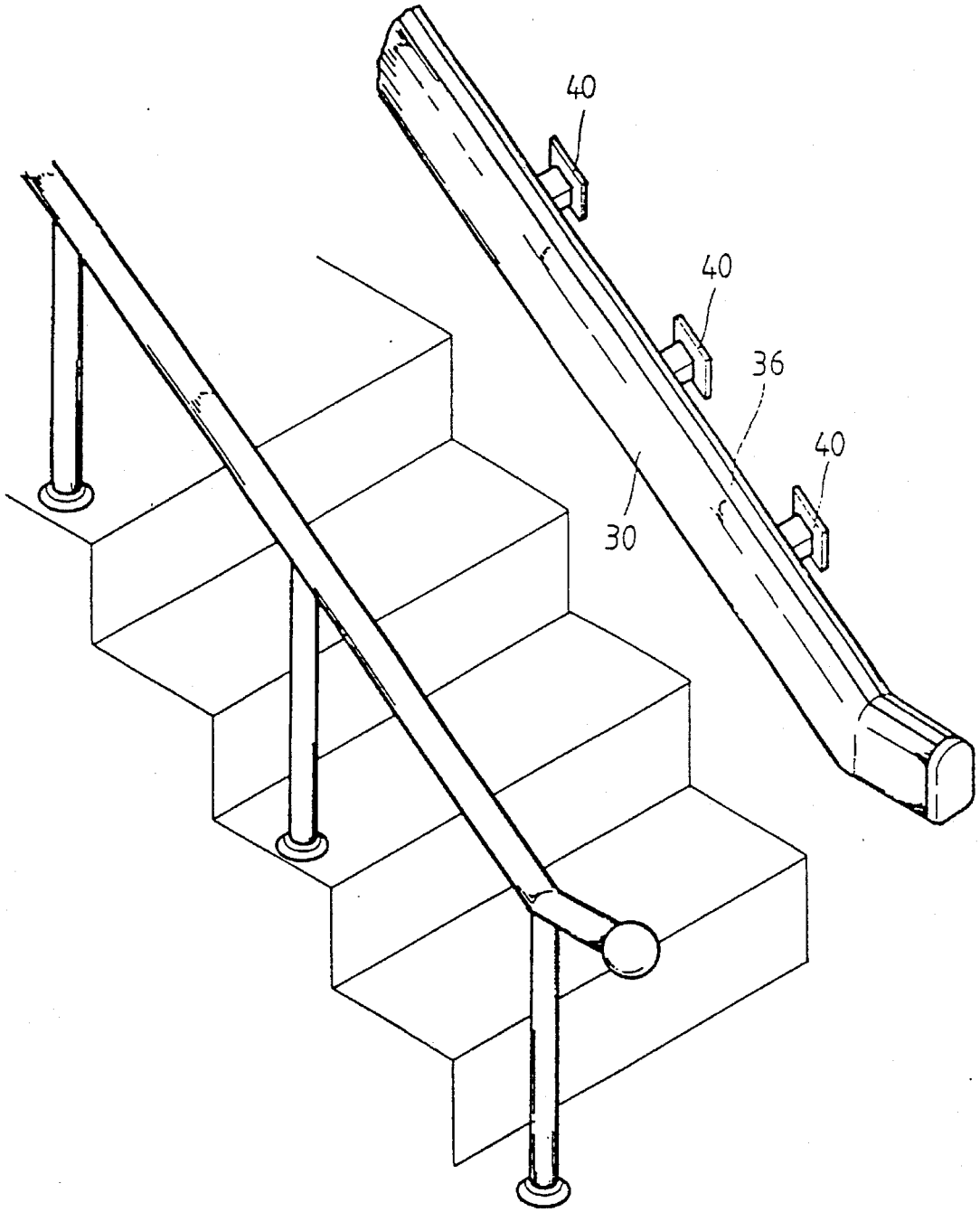
FIG. 1 is a working view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the structure of a handrail for a staircase according to the present invention mainly comprises a rail 30 and a plurality of supporters 40.

Figure 2:
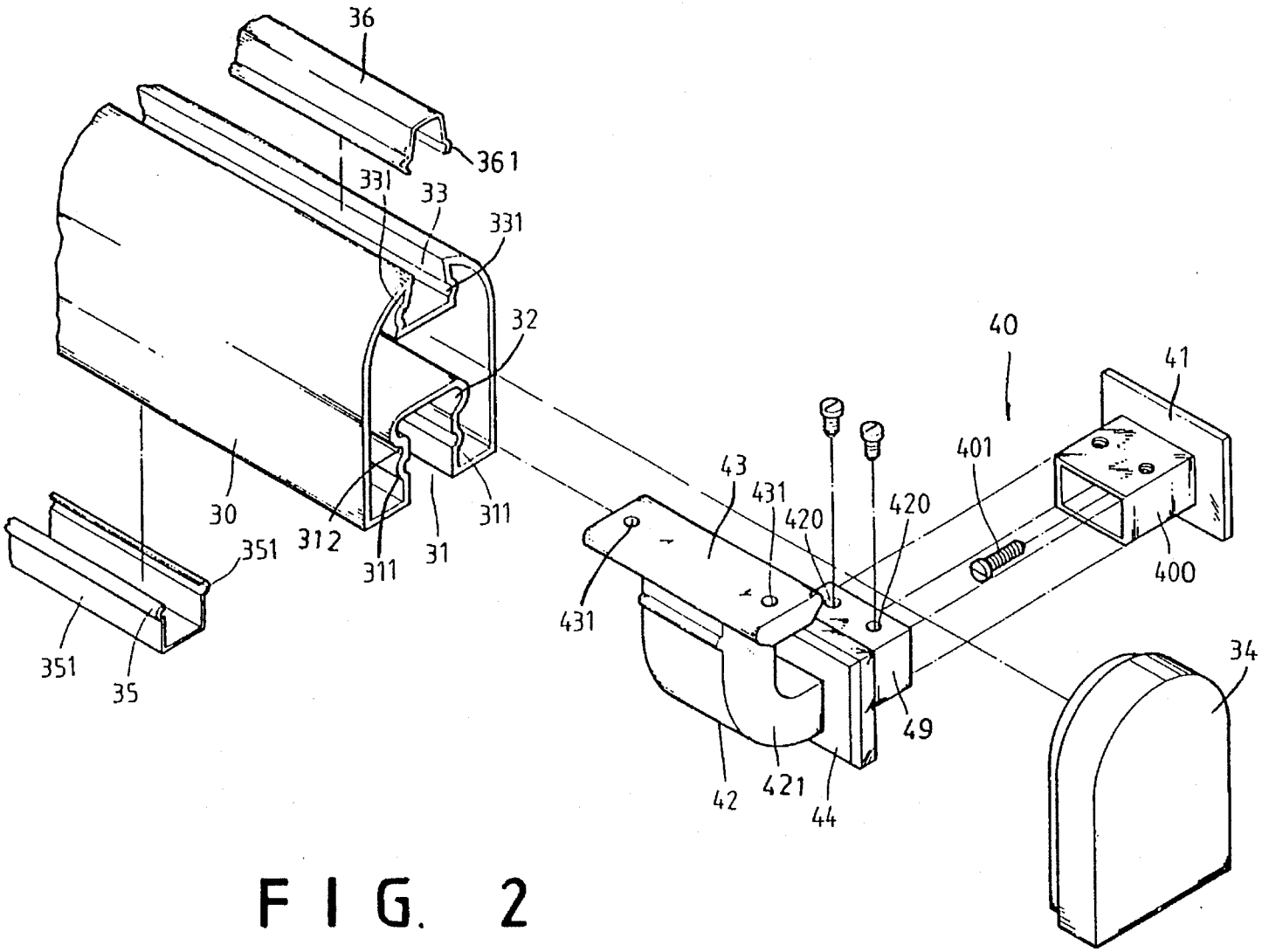
FIG. 2 is an exploded view of the present invention.
Figure 3:
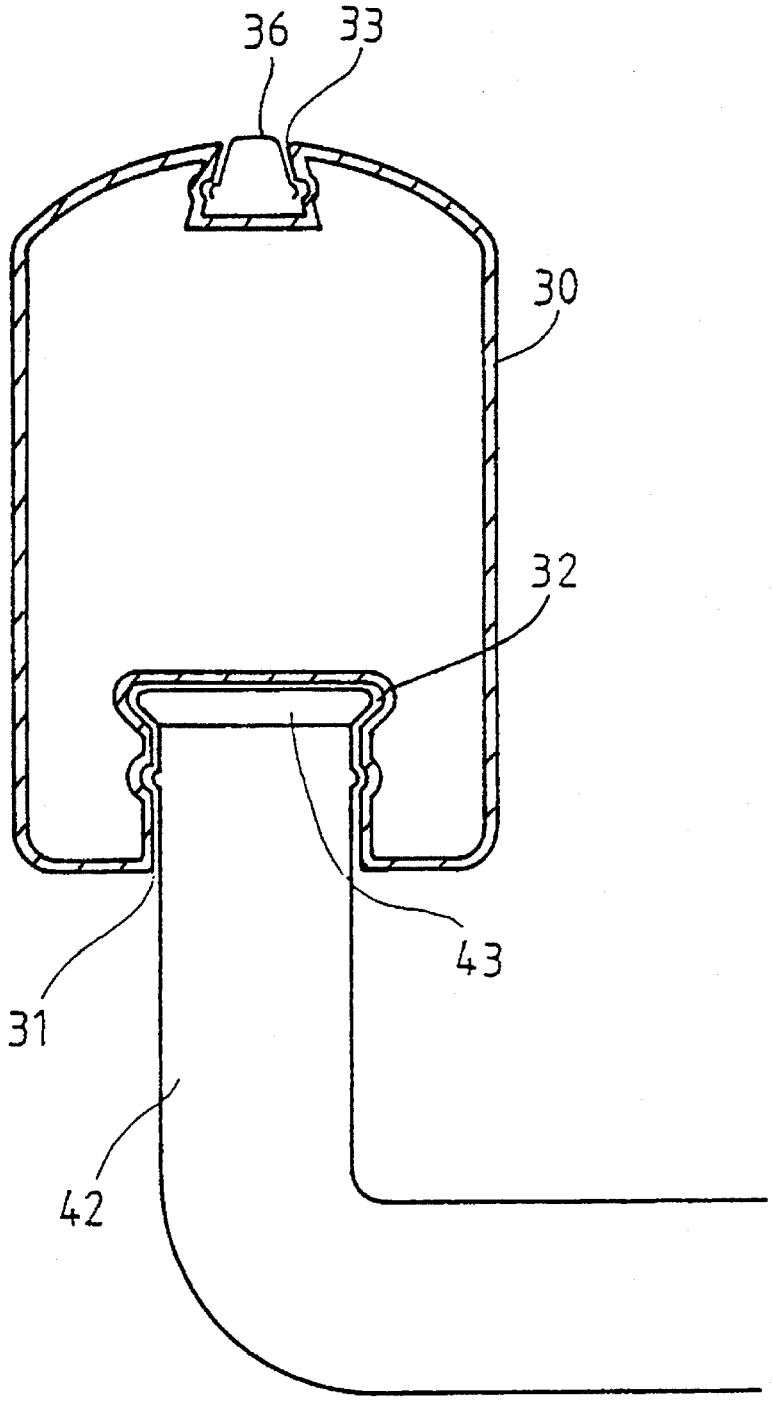
FIGS. 3 and 4 are sectional views of the present invention.
Figure 4:
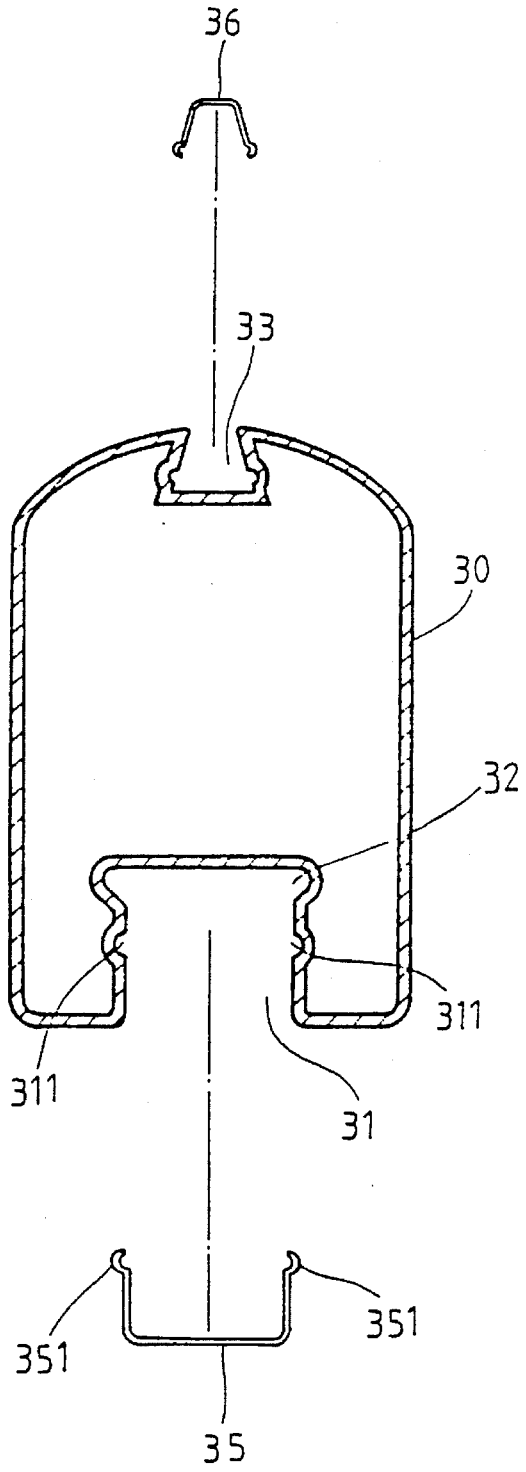

Turning now to FIG. 2, the rail 30 is an elongated tubular member with a lower longitudinal groove 31 and an upper longitudinal groove 33. The lower longitudinal groove 31 is formed with an enlarged portion 32 at the upper portion, a neck portion 312 under the enlarged upper portion 32 on both sides, and a recessed path 311 under the neck portion 28 on both sides. The upper longitudinal groove 33 is formed with a recessed path 331 at both sides. The supporter 40 includes a curved connector 42 and a base 41 which is to be fixedly secured on a wall (not shown) by a screw 401. The base 41 is formed with a tubular portion 400. The curved connector 42 includes a curved portion 421, a tubular portion 49 at one end of the curved portion 421 for engaging the tubular portion 400 of the base 40 by screws 401, and a wing portion 43 at the other end for slidably engaging the enlarged upper portion 32 of the rail 30. Between the tubular portion 49 and the curved portion 421 there is a flange 44. The curved connector 42 is fixedly secured to the rail 30 by screws (not shown) extending through holes 431 of the wing portion 43 of the curved connector 42 to the inner surface of the enlarged portion 32 of the rail 30. A protective cap 34 is fitted in both ends of the rail 30 for preventing the interior of the rail 30 from being made dirty. In addition, a U-shaped lower cover 35 is connected with the lower portion of the rail 30 with its upper edge 351 engaged with the recessed path 311 of the rail 30. Further, a U-shaped upper cover 36 with fluorescent material on the upper surface is fitted into the upper portion of the rail 30 with its lower edge 361 engaged with the recessed path 331 of the rail 30 (see FIGS. 3 and 4).

Figure 5:
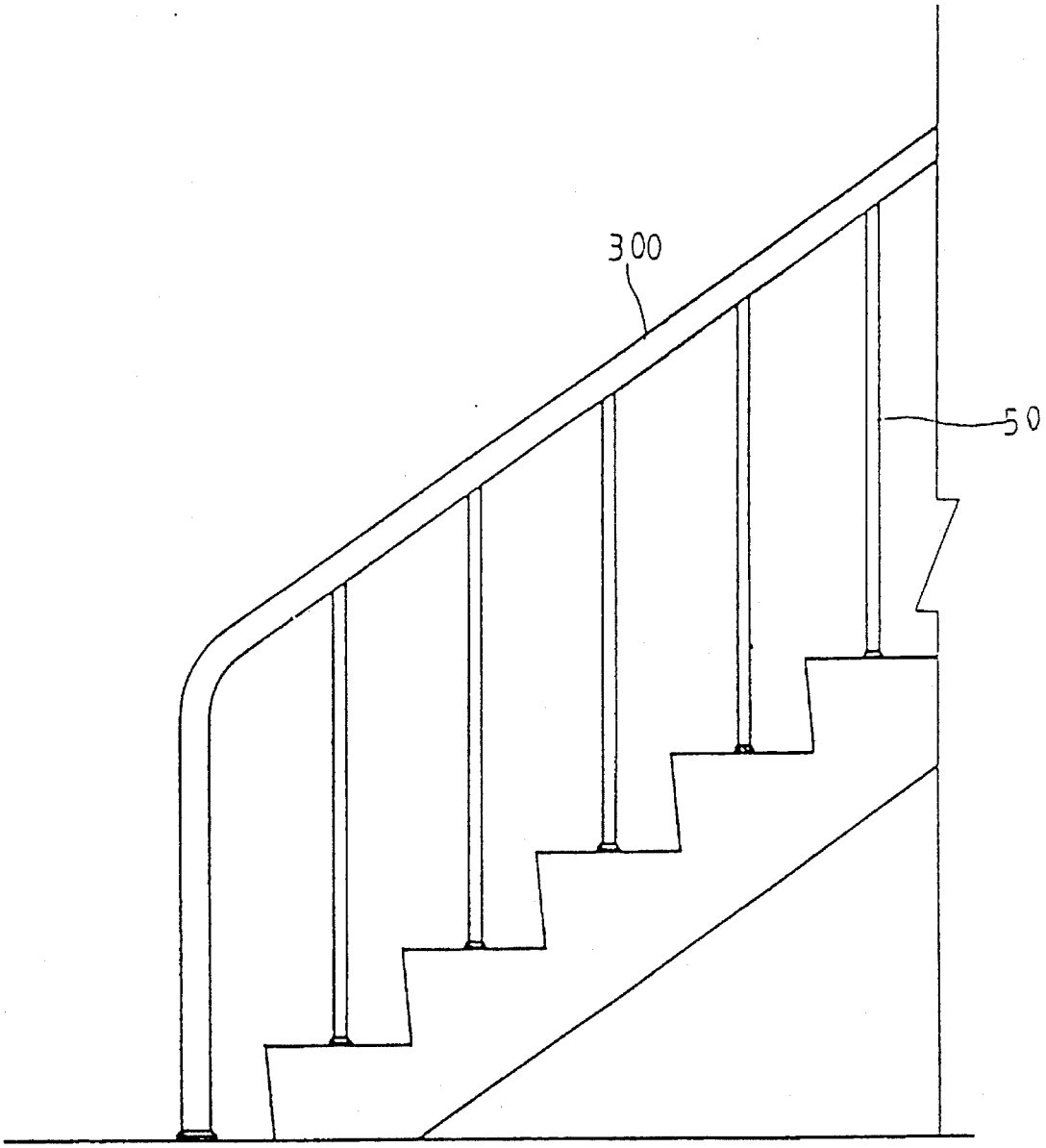
FIG. 5 shows another application of the present invention.

As shown in FIGS. 1 and 5, the principle of the present invention may be also applied to a rail 300 which is slidably engaged with wing portions of the vertical supports 50.

Figure 6A:
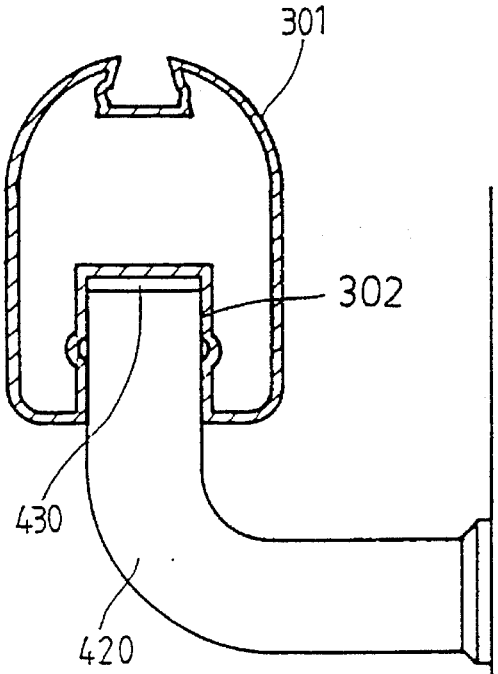
FIG. 6A shows a second preferred embodiment of the present invention.

FIG. 6A shows a second preferred embodiment of the present invention wherein the rail 301 is formed with a rectangular groove 302 engageable with the wing portion 430 of the curved connector 420.

Figure 6B:
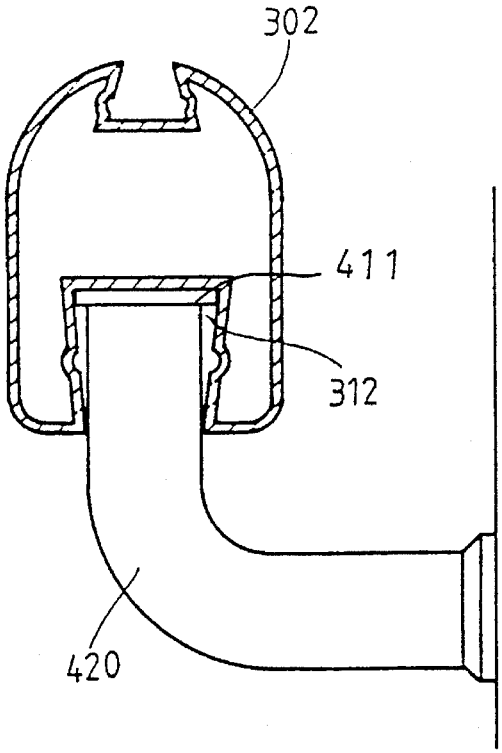
FIG. 6B shows a third preferred embodiment of the present invention.

FIG. 6B shows a third preferred embodiment of the present invention wherein the rail 302 is formed with an inverted trapezium groove 312 engageable with the wing portion 411 of the curved connector 420.

Figure 7:
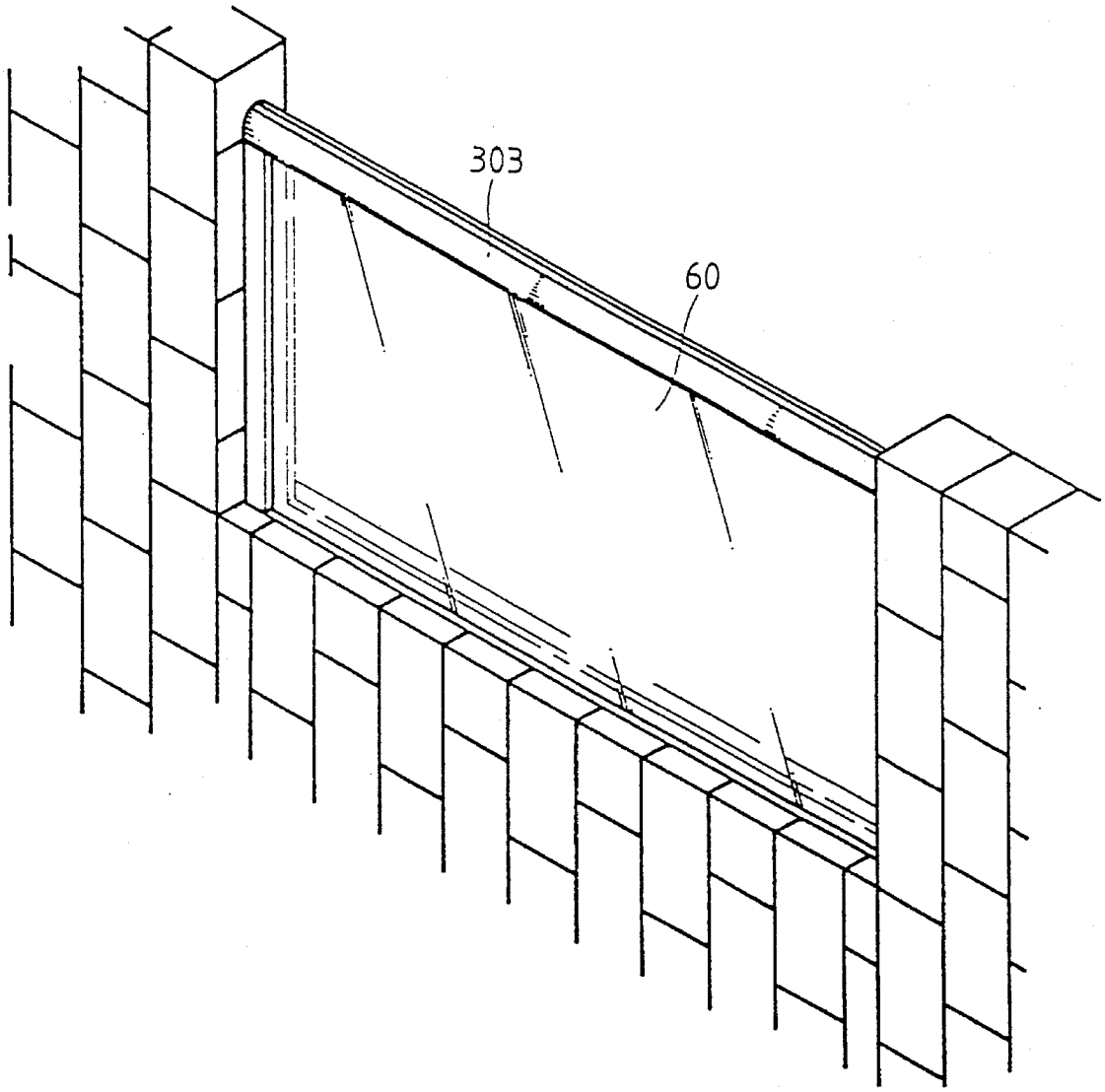
FIG. 7 shows a third application of the present invention.
Figure 8:
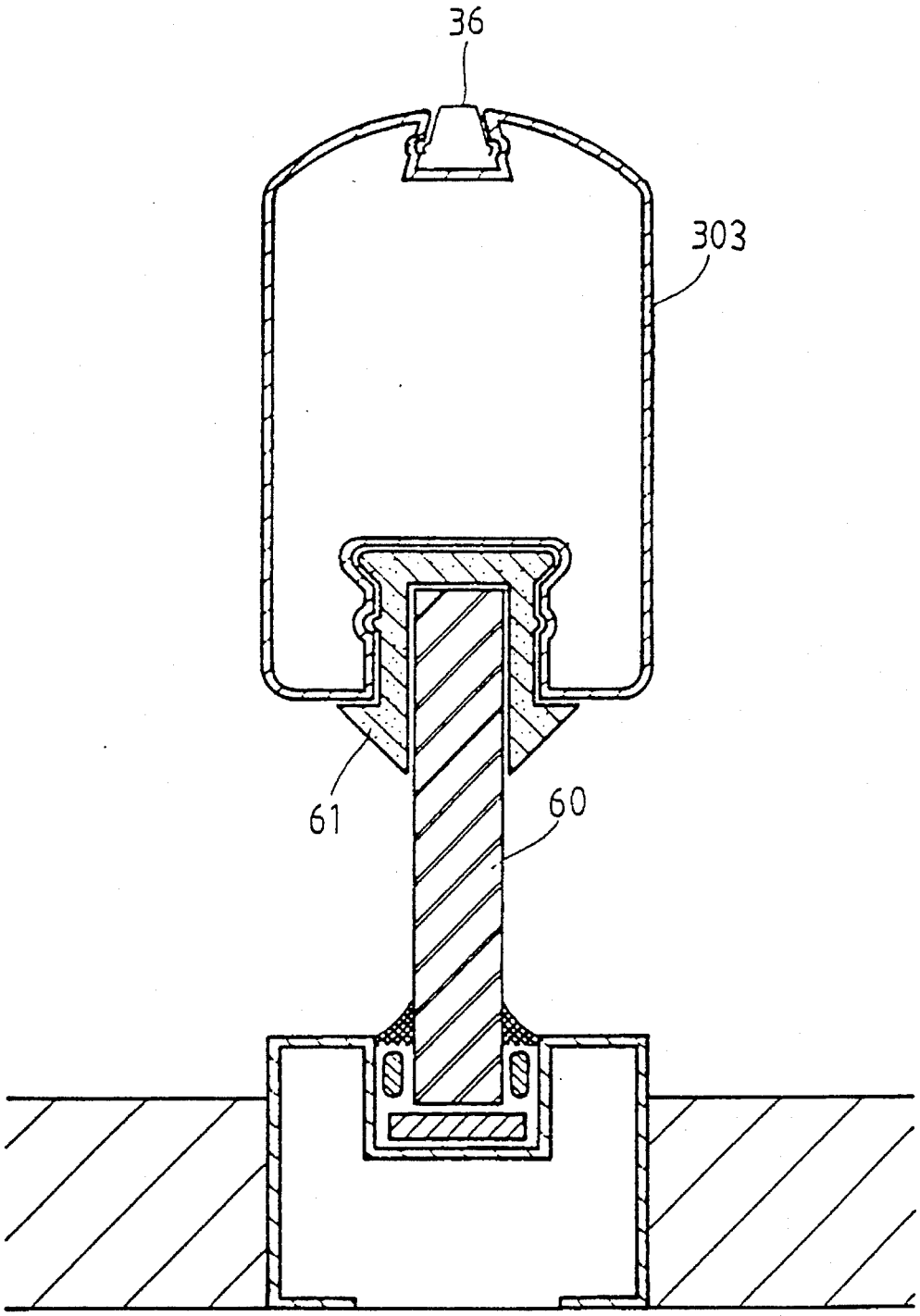
FIG. 8 shows a fourth preferred embodiment of the present invention.
Figure 9:
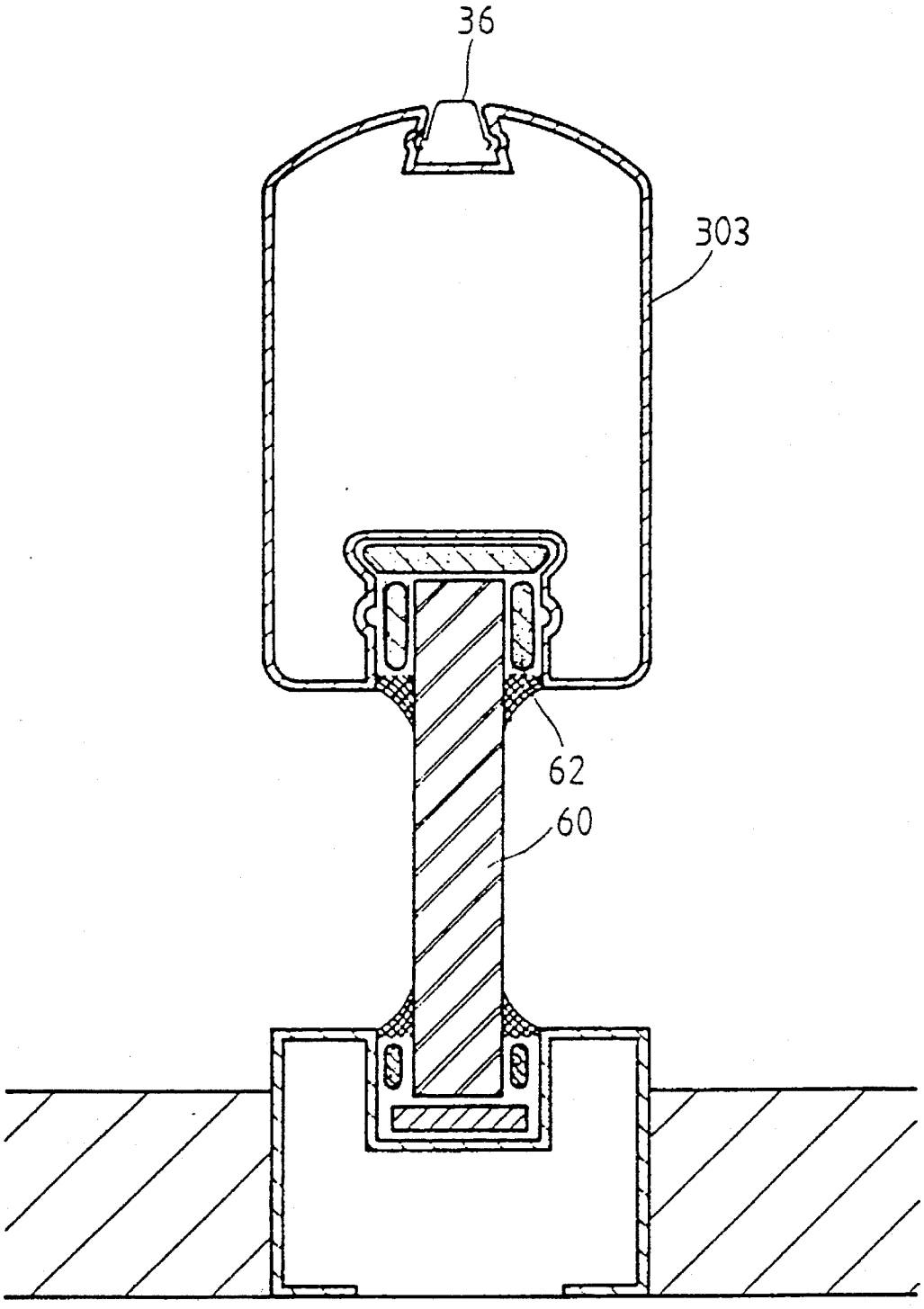
FIG. 9 shows a fifth preferred embodiment of the present invention.

FIGS. 7, 8 and 9 show a third application of the present invention wherein the rail 303 is engaged with an edge of a pane 60 and a plastic clip 61 or a filling 62 is inserted between the rail 303 and the pane 60.

Figure 10:
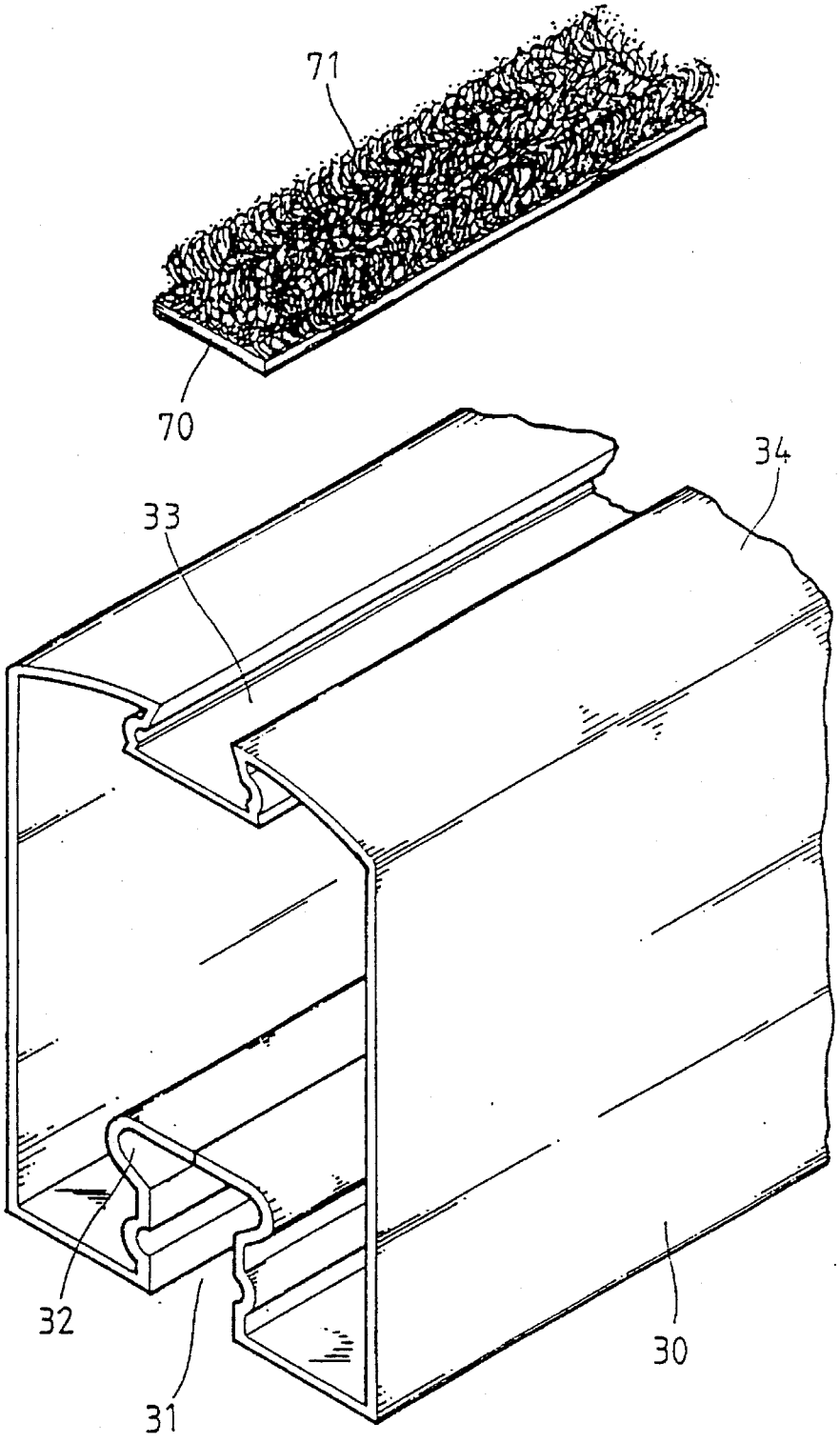
FIGS. 10 and 11 show a fourth application of the present invention.
Figure 11:
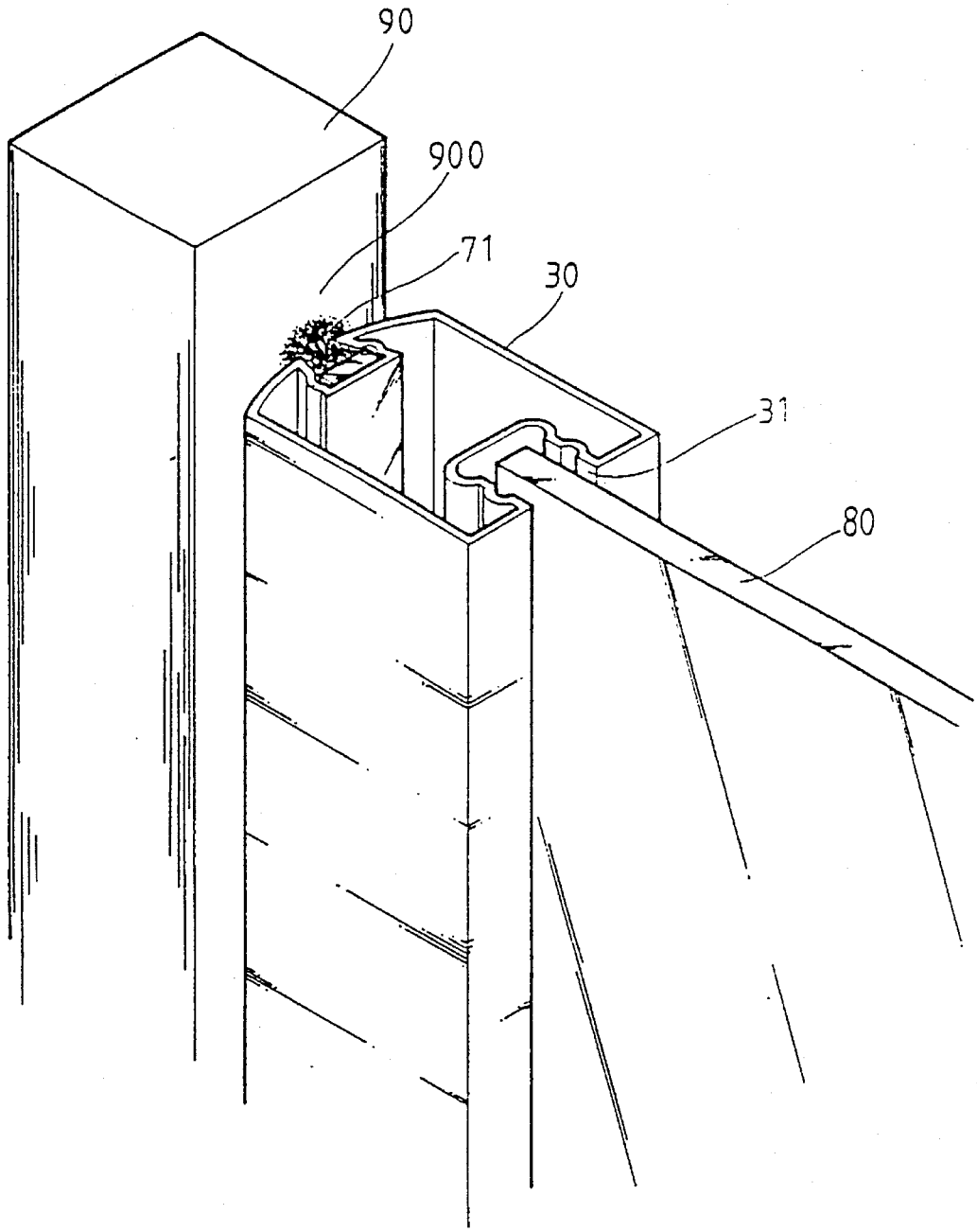
Figures 12A, 12B, 12C:
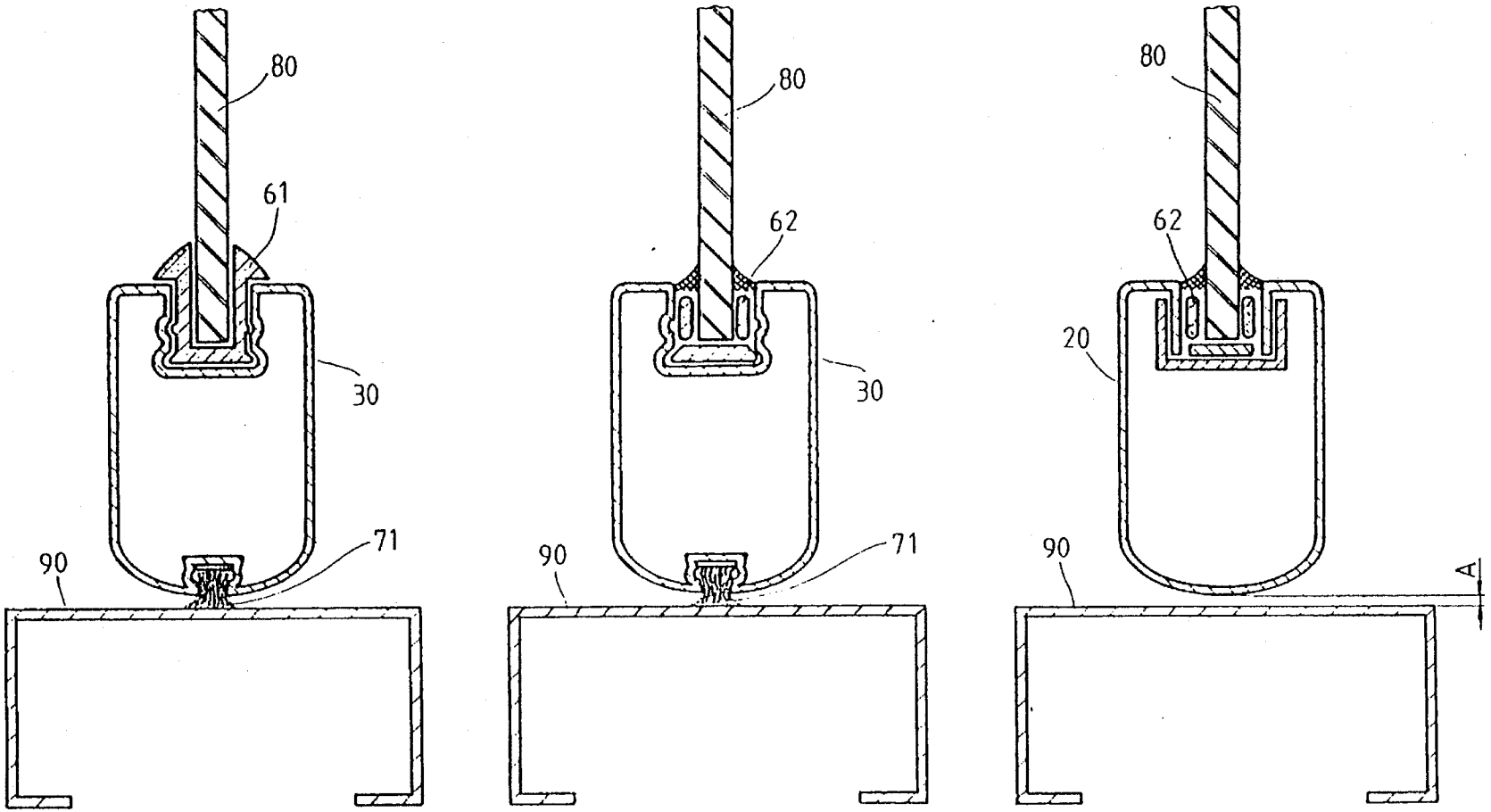
FIGS. 12A, 12B and 12C are sectional views showing the fourth application of the present invention.

FIGS. 10 and 11 show a fourth application of the present invention. FIGS. 12A, 12B and 12C are sectional views showing the fourth application of the present invention. As illustrated, an elongated member 70 is inserted into the upper longitudinal groove 33 of the rail 30 and a strip of brush member 71 is adhered on the elongated member 70. Hence, when the rail 30 is mounted on a glass door 80, the brush 71 will be in close contact with the inner side 900 of the pillar 90 thereby sealing the clearance between the glass door 80 and the pillar 90.

Figure 13:
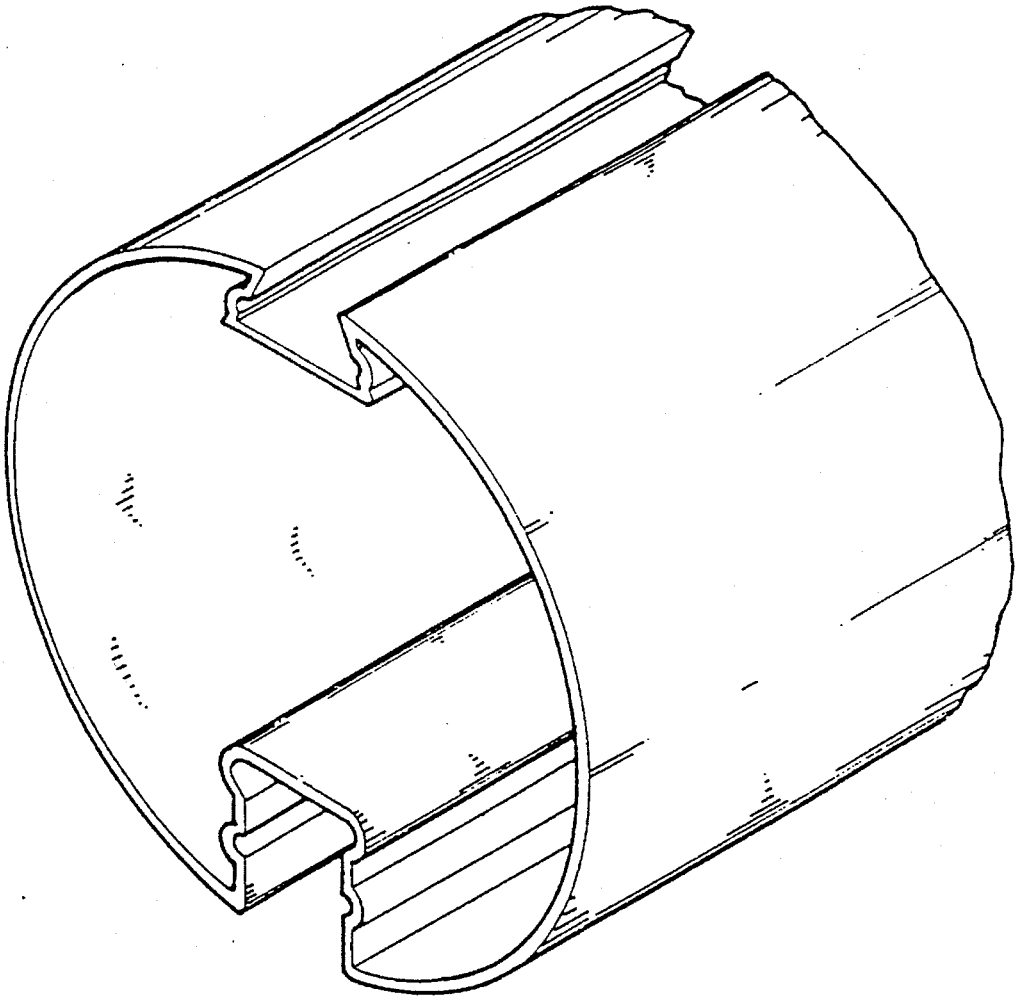
FIG. 13 shows a sixth preferred embodiment of the present invention.
Figure 14:
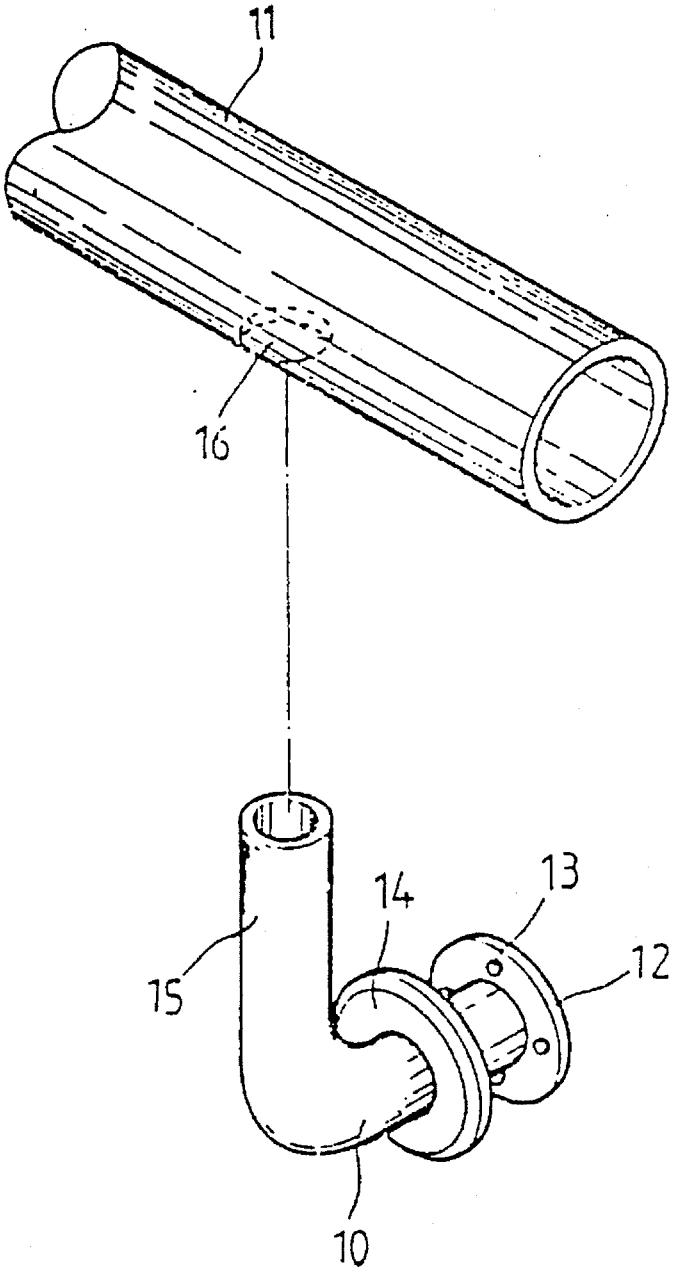
PRIOR ART FIG. 14
FIG. 14 shows the structure a prior art handrail.
Figure 15:
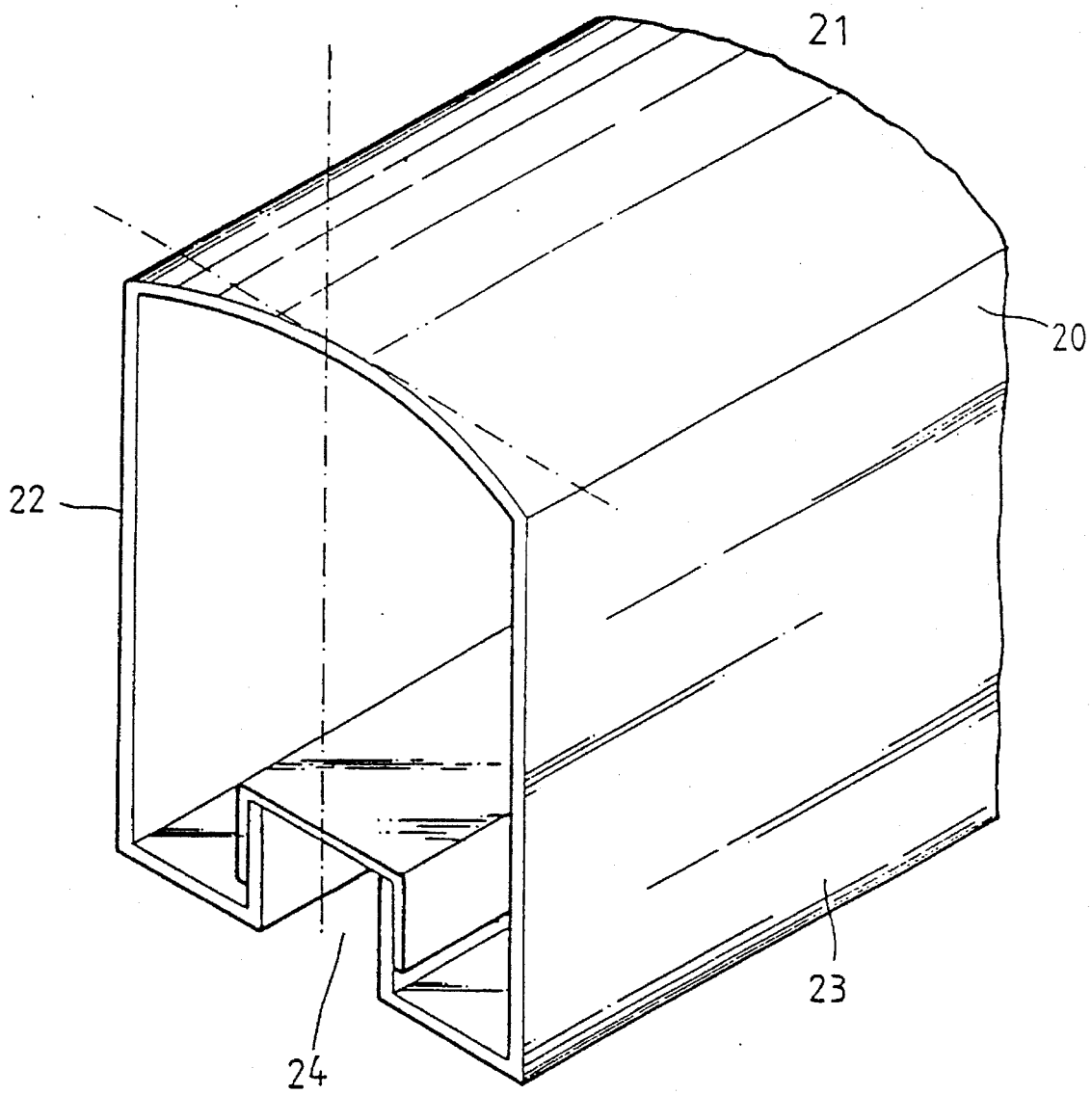
PRIOR ART FIG. 15
FIG. 15 shows the structure of a prior art sash.

FIG. 13 shows a sixth preferred embodiment of the present invention wherein the rail has a circular cross section.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A structure of a handrail for a staircase comprising:

a rail formed with a first longitudinal groove at a lower side and a second longitudinal groove at an upper side, said second longitudinal groove being formed with an enlarged portion at an upper portion, a neck portion under said enlarged portion, and two opposite recessed paths under said neck portion;

a plurality of supporters each including a curved connector and a base, said base being formed with a first tubular portion, said curved connector including a curved portion, a second tubular portion at one end of said curved portion adapted to engage with said first tubular portion, a flange between said curved portion and said second tubular portion, and a wing portion at another end of said curved portion adapted to slidably engaging with the enlarged portion of said rail;

a protective cap at both ends of said rail;

a first U-shaped cover engaged with the first longitudinal groove of said rail; and a second U-shaped cover engaged with the second longitudinal groove of said rail and provided with fluorescent material.

* * * * *